US012740636B2

(12) United States Patent
Zhang

(10) Patent No.: US 12,740,636 B2
(45) Date of Patent: Sep. 22, 2026

(54) ADJUSTING DEVICE FOR SHOULDER STRAP OF BAG

(71) Applicant: PGYTECH CO., LTD, Jiangsu (CN)

(72) Inventor: Ying Zhang, Jiangsu (CN)

( * ) Notice: Subject to any disclaimer, the term of this patent is extended or adjusted under 35 U.S.C. 154(b) by 84 days.

(21) Appl. No.: 18/896,648

(22) Filed: Sep. 25, 2024

(65) Prior Publication Data

US 2025/0017339 A1 Jan. 16, 2025

(30) Foreign Application Priority Data

Jan. 24, 2024 (CN) ..... 202420167120.X

(51) Int. Cl.
*A45F 3/04* (2006.01)

(52) U.S. Cl.
CPC ..... *A45F 3/047* (2013.01)

(58) Field of Classification Search
CPC ..... A45F 3/047
USPC ..... 224/631
See application file for complete search history.

(56) References Cited

U.S. PATENT DOCUMENTS 5,005,744 A * 4/1991 Gleason ..... A45F 3/047 224/901.4
5,586,699 A * 12/1996 Heisler ..... A45F 3/047 224/259
5,730,347 A * 3/1998 Finot ..... A45F 3/047 224/628
8,844,781 B2 * 9/2014 Rose ..... A45C 13/30 224/628
11,758,998 B2 * 9/2023 Keidel ..... A45F 3/047 224/201
2005/0045686 A1 * 3/2005 Yeh ..... A45F 3/047 224/632
2021/0100340 A1 * 4/2021 Chang ..... A45F 3/047
2023/0270187 A1 * 8/2023 Ross ..... A44B 13/0029 2/300
2025/0017339 A1 * 1/2025 Zhang ..... A45F 3/047

FOREIGN PATENT DOCUMENTS

DE 202014007494 U1 * 1/2015 ..... A45F 3/047
EP 1625807 A2 * 2/2006 ..... A45F 3/047
EP 4260754 B1 * 11/2024 ..... A45C 13/001
FR 2669519 A1 * 5/1992 ..... A45F 3/047
FR 2670096 A1 * 6/1992 ..... A45F 3/047
FR 2778825 A1 * 11/1999 ..... A45F 3/047
WO WO-9221265 A1 * 12/1992 ..... A45F 3/047
WO WO-2025174769 A1 * 8/2025 ..... A45F 3/047

* cited by examiner

*Primary Examiner* — Justin M Larson
(74) *Attorney, Agent, or Firm* — Hawaii Patent Services; Nathaniel K. Fedde; Kenton N. Fedde

(57) ABSTRACT

An adjusting device for a shoulder strap of a bag comprises a first adjusting member arranged in a first direction, wherein two ends of the first adjusting member are provided with assembly member; a second adjusting member arranged in the second direction, wherein the second adjusting member is provided with a plurality of assembly parts matched with the assembly members, and the assembly members are assembled with the assembly parts at different positions in the second direction to realize the assembly of the first adjusting member and the second adjusting member at different positions in the second direction.

13 Claims, 4 Drawing Sheets

A

ADJUSTING DEVICE FOR SHOULDER STRAP OF BAG

CROSS-REFERENCE TO RELATED APPLICATIONS

This application claims the priority of China Patent Application No. 202420167120.X filed on Jan. 24, 2024, entitled "Adjusting Device for Shoulder Strap of Bag", the entire contents and amendments of which are incorporated into this application by reference.

TECHNICAL FIELD

The present disclosure relates to the technical field of bag shoulder strap adjustment, in particular to an adjusting device for a shoulder strap of a bag.

BACKGROUND

At present, there are four main ways to adjust the position of the shoulder strap of a bag, i.e., hook-and-loop type, large-area hook and loop adhesive type, hook and loop fixed shoulder strap type and belt fixed buckle type, and various back length adjustment methods that have evolved therefrom.

The existing shoulder strap position adjustment method has the widest application range, but the disadvantages are that the adjustment method is complex, it is not easy to remove the hook, and it is difficult to make it beautiful. The disadvantages of large-area hook and loop lie in reliability, adjustment difficulty and accuracy. Because of the large-area hook and loop, the strap can be stuck everywhere, and it is difficult to adjust the strap to a required position accurately. The operation of the hook and loop fixed shoulder strap type is complicated. The disadvantage of the belt fixed buckle type is that its requirement for the structure of the bag is high and the overall weight is large.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

The object of the present disclosure is to provide an adjusting device for a shoulder strap of a bag, which can adjust the length of the shoulder strap by simply adjusting the assembly position of assembly members and assembly parts, and is simple in structure and convenient in operation.

In order to solve the above problems, the present disclosure adopts the following technical solution:

The present disclosure provides an adjusting device for a shoulder strap of a bag, which includes a first adjusting member arranged in a first direction, wherein two ends of the first adjusting member are provided with assembly members; a second adjusting member arranged in a second direction, wherein the second adjusting member is provided with a plurality of assembly parts matched with the assembly members, and the assembly members are assembled with the assembly parts at different positions in the second direction to realize the assembly of the first adjusting member and the second adjusting member at different positions in the second direction; and the second adjusting member is arranged along an adjusting direction of the shoulder strap on the bag, and the first adjusting member is connected with the bag through the second adjusting member.

The present disclosure further provides an adjusting device for a bag shoulder strap, which includes a first adjusting member arranged in a first direction, wherein two ends of the first adjusting member are provided with assembly members; a second adjusting member arranged in a second direction, wherein the second adjusting member is provided with a plurality of assembly parts matched with the assembly members; the assembly member is a closed loop, and the assembly part is a groove structure; the assembly members are assembled with the assembly parts at different positions in the second direction to realize the assembly of the first adjusting member and the second adjusting member at different positions in the second direction; and the second adjusting member is arranged along an adjusting direction of the shoulder strap on the bag, and the first adjusting member is connected with the bag through the second adjusting member.

The present disclosure further provides an adjusting device for a bag shoulder strap, including a first adjusting member arranged in a first direction and a second adjusting member arranged in a second direction; the first adjusting member and the second adjusting member are engaged and connected in the second direction; the second adjusting member is arranged along an adjusting direction of the shoulder strap on the bag, the first adjusting member is connected with the shoulder strap, and the first adjusting member is connected with the bag through the second adjusting member.

BRIEF DESCRIPTION OF DRAWINGS

In order to explain the technical scheme of this application more clearly, the drawings needed in the implementation will be briefly introduced below. Obviously, the drawings described below are only some implementations of this application. For those skilled in the art, other drawings can be obtained according to these drawings without creative work.

Figure 1:
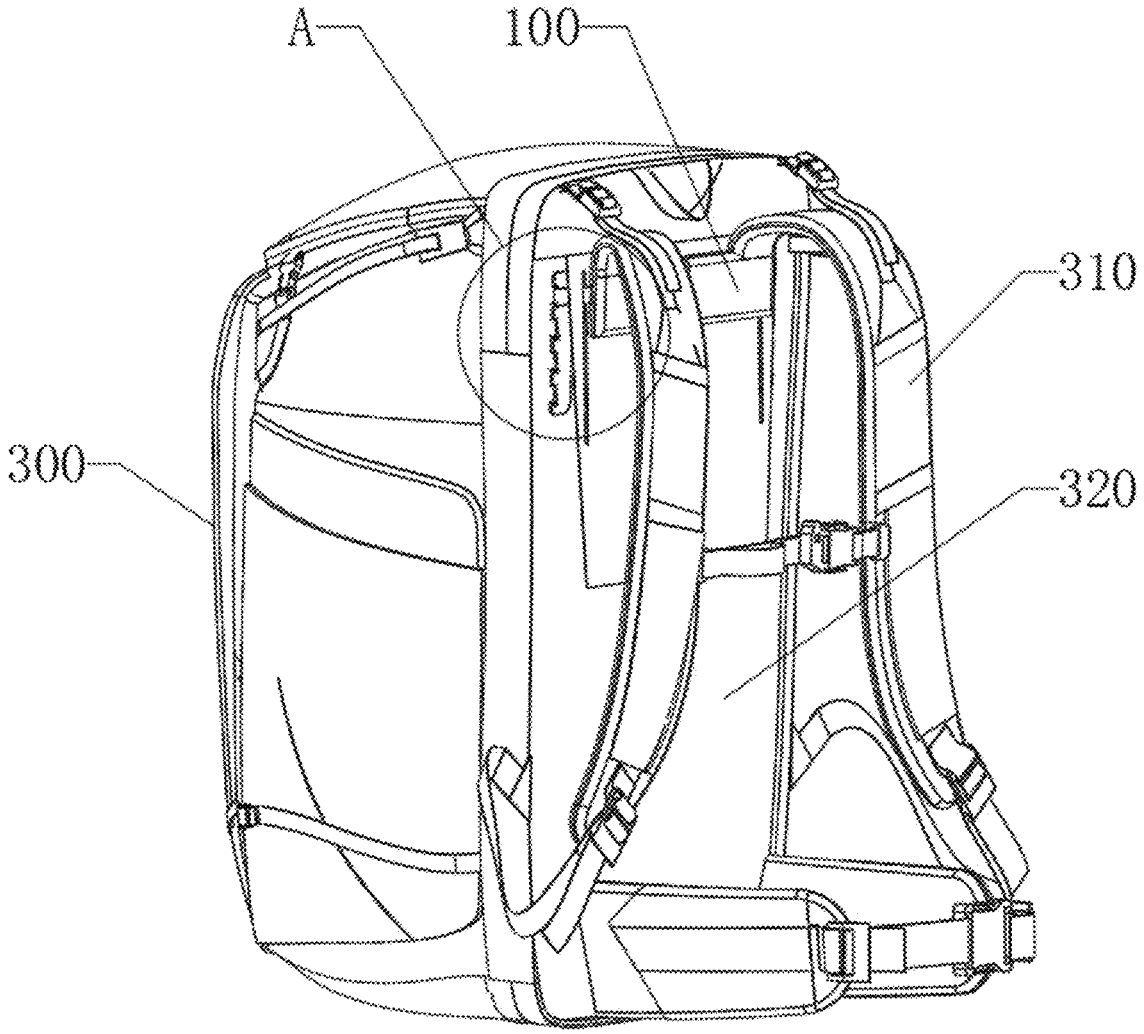
FIG. 1 is a schematic structural view of the adjusting device of the present disclosure when it is installed on a bag.

Reference signs: First adjusting member (100); Assembly member (110); Second adjusting member (200); Assembly part (210); Adjusting buckle (230); Bag (300); Shoulder strap (310); Bag body (320); Binding part (330).

DESCRIPTION OF EMBODIMENTS

In describing the preferred embodiments, specific terminology will be resorted to for the sake of clarity. It is to be understood that each specific term includes all technical equivalents which operate in a similar manner to accomplish a similar purpose.

While various aspects and features of certain embodiments have been summarized above, the following detailed description illustrates a few exemplary embodiments in further detail to enable one skilled in the art to practice such embodiments. Reference will now be made in detail to embodiments of the inventive concept, examples of which are illustrated in the accompanying drawings. The accompanying drawings are not necessarily drawn to scale. The described examples are provided for illustrative purposes and are not intended to limit the scope of the invention. It should be understood, however, that persons having ordinary skill in the art may practice the inventive concept without these specific details.

It will be understood that, although the terms first, second, etc. may be used herein to describe various elements, these elements should not be limited by these terms. These terms are only used to distinguish one element from another. For example, a first attachment could be termed a second attachment, and, similarly, a second attachment could be termed a first attachment, without departing from the scope of the inventive concept.

It will be understood that when an element or layer is referred to as being "on," "coupled to," or "connected to" another element or layer, it can be directly on, directly coupled to or directly connected to the other element or layer, or intervening elements or layers may be present. In contrast, when an element is referred to as being "directly on," "directly coupled to," or "directly connected to" another element or layer, there are no intervening elements or layers present. Like numbers refer to like elements throughout. As used herein, the term "and/or" includes any and all combinations of one or more of the associated listed items.

As used in the description of the inventive concept and the appended claims, the singular forms "a," "an," and "the" are intended to include the plural forms as well, unless the context clearly indicates other.

As shown in FIGS. 1-5, the adjusting device for a shoulder strap of a bag in this embodiment, through the first adjusting member 100 and the second adjusting member 200 assembled on a schoolbag or other bags, solves the use complexity brought by the traditional ways of buckle and hook and loop, and realizes the characteristics of low cost, convenience in use and simple structure.

As shown in FIGS. 1-5, in this embodiment, the adjusting device for shoulder straps of bags includes a first adjusting member 100 arranged in a first direction and a second adjusting member 200 arranged in a second direction. The horizontal direction is the first direction and the vertical direction for adjustment is the second direction. Assembly members 110 are arranged at both ends of the first adjusting member 100, and a plurality of assembly parts 210 matched with the assembly members 110 are arranged on the second adjusting member 200. At this time, the first adjusting member 100 is horizontally arranged, and the assembly members 110 are assembled with the assembly parts 210 at different positions in the second direction, so that the height position of the first adjusting member 100 in the vertical direction is adjusted, thereby realizing assembly of the first adjusting member 100 and the second adjusting member 200 at different positions in the second direction. The adjusting device in this embodiment is firmer compared with sticking of the hook and loop fastener, and a simpler assembly mode compared with buckles.

In a preferred embodiment of this embodiment, the first adjusting member 100 is a rectangular flat plate, and the assembly members 110 on the first adjusting member 100 are elastic ropes, which are arranged on the left and right sides of the first adjusting member 100. One end of the left elastic rope is connected with the upper left side of the rectangular plate, the other end of the left elastic rope is connected with the lower left side of the rectangular plate. One end of the right elastic rope is connected with the upper right side of the rectangular plate, and the other end is connected with the lower right side of the rectangular plate. In order to increase the clamping force of the elastic rope in the groove 220, sewing threads are arranged on the elastic rope to form two closed loops. When the closed loop close to the first adjusting member 100 is engaged in the groove 220, the closed loop close to the first adjusting member 100 does not recover to its original state, there is still a certain contraction force, and the elastic rope is engaged in the groove 220, so that the first adjusting member 100 can be stabilized at a certain height without changing the height by itself.

Of course, the assembly member 110 is not limited to elastic rope, but can also be made of an inelastic material, such as nylon, polyester, carbon fiber and other high-toughness materials. Through this inelastic and high-toughness material, the assembly member 110 has stronger load-bearing and tensile capacity and is not easy to break, so that the structural strength of the whole adjusting device is higher.

In this embodiment, the second adjusting member 200 is a rectangular flat plate with grooves 220, which are symmetrically arranged on the left and right sides. The assembly part 210 matched with the assembly member 110 on the second adjusting member 200 is a trough structure, and the trough structure has a plurality of grooves 220 with the same size and equidistantly distributed in the vertical direction, and these grooves 220 are used for engaging with the assembly member 110, so that the first adjusting member 100 is vertically (in the second direction).

Specifically, in the use state, the closed loop close to the first adjusting member 100 is engaged in one of the grooves 220 of the groove structure. When it is necessary to adjust the position of the first adjusting member 100 in the vertical direction, it is only necessary to stretch the closed loop far away from the first adjusting member 100 outward, so that the closed loop close to the first adjusting member 100 can be separated from the groove 220 and moved upward or downward to the outside of one of the grooves 220 with corresponding height, and then the closed loop far away from the first adjusting member 100 can be released, and the closed loop close to the first adjusting member 100 can be engaged back into the groove 220 under the action of elastic force to complete the position change of the first adjusting member 100 in the vertical direction.

In other embodiments (not shown), the first adjusting member 100 is detachably connected with the assembly member 110. Specifically, the top of both sides of the first adjusting member 100 is provided with through holes that run through the side surfaces, and at the same time, the bottom and the side surfaces are also provided with corresponding through hole structures. The assembly member 110 is made of elastic rope with flexibility, and its shape and size are adapted to pass through all the above-mentioned through holes. Because the assembly member 110 is an elastic component, its elasticity may gradually decline after a long period of frequent use, and thus it needs to be replaced. Therefore, the through hole in the first adjusting member 100 allows the user to easily replace the assembly member 110 by himself, thus ensuring the continuous and effective use of the product.

Figure 5:
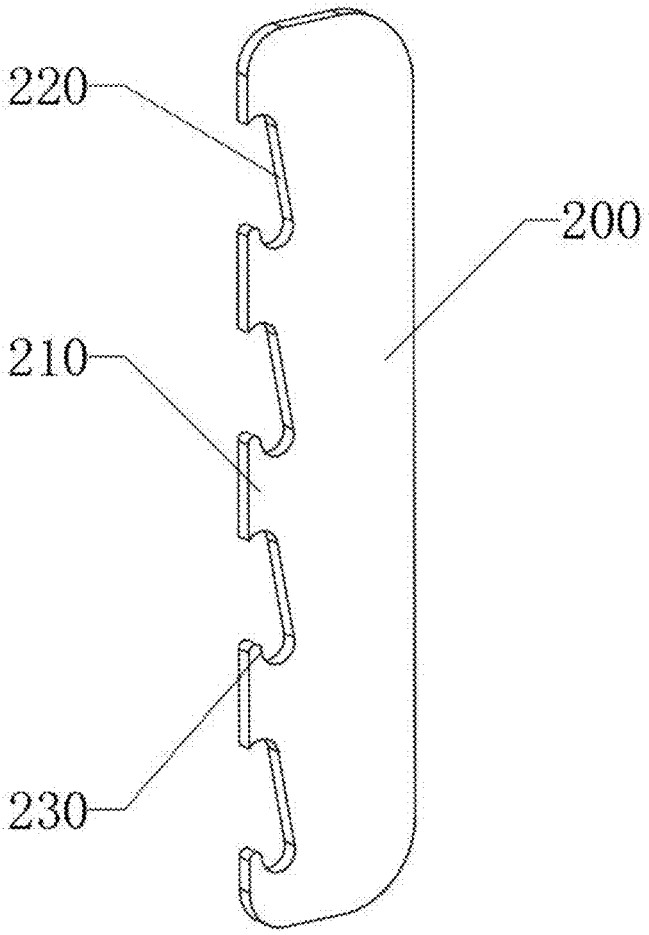
FIG. 5 is a schematic structural view of the second adjusting member of the present disclosure.

In this embodiment, as shown in FIG. 5, in order to facilitate operation and adjustment, the groove structure is provided with an adjusting buckle 230 for cooperating with the closed loop. When adjusting the position of the first adjusting member 100, the adjusting buckle 230 is hooked with the closed loop to achieve a more stable connection.

In other embodiments (not shown), the groove 220 in the groove structure can be a T-shaped groove, and the width of the assembly member 110 is the same as that in the vertical direction in the T-shaped groove. When the assembly member 110 is engaged into the T-shaped groove, it is necessary to fold the assembly member 110 into the groove in the horizontal direction in the T-shaped groove, and then unfold the assembly member 110 when it reaches the groove in the vertical direction in the T-shaped groove at the bottom, The groove width in the vertical direction is larger than that in the horizontal direction, and thus it has a certain blocking effect on the assembly member 110, so that the assembly member 110 can be better engaged in the T-shaped groove.

As shown in FIG. 1, in this embodiment, the bag 300 includes a shoulder strap 310 and a bag body 320. The shoulder strap 310 is connected with the first adjusting member 100, and the second adjusting member 200 is fixed at the side of the bag body 320. The first adjusting member 100 is connected with the bag 300 through the second adjusting member 200. The second adjusting member 200 is arrange on that bag 300 along the adjusting direction of the shoulder strap 310, that is, the shoulder strap 310 is mainly adjusted in the vertical direction in a normal state, so that when the bag is used, the position of the shoulder strap 310 on the bag body 320 is adjusted by adjusting the height of the first adjusting member 100.

The shoulder strap 310 of the bag itself is partially connected with the bag body 320. The bag body 320 is provided with a buckle, which is placed at the top of the bag body 320. The shoulder strap 310 is connected with the buckle through a connecting belt. The connecting belt and the buckle mainly play the role of bearing the weight of the bag body 320.

In addition, in other embodiments (not shown), in order to facilitate the use and reduce the influence on other structures, the shoulder strap 310 can also be provided with an assembly cavity in the horizontal direction, and the first adjusting member 100 is partially placed in the assembly cavity, while the assembly members 110 are exposed at both ends of the assembly cavity. For example, in a bag, the assembly cavity can be a connecting belt arranged between two shoulder straps. The first adjusting member 100 is partially placed in the connecting belt, and then the height of the first adjusting member 100 is adjusted through the connection between the assembly member 110 and the assembly part 210, so as to realize the connection of the shoulder strap 310 at different positions in the height direction of the bag body 320.

Figure 2:
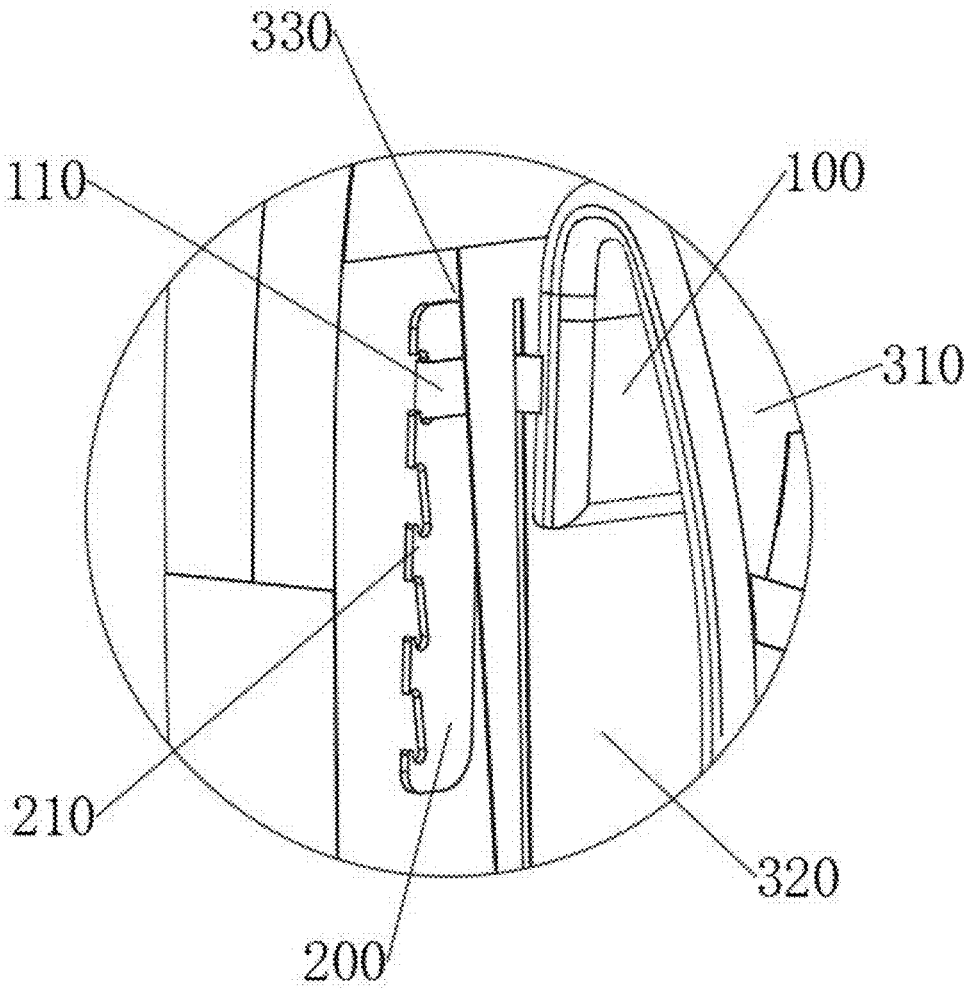
FIG. 2 is a partially enlarged schematic view at A of FIG. 1 of the present disclosure.
Figure 3:
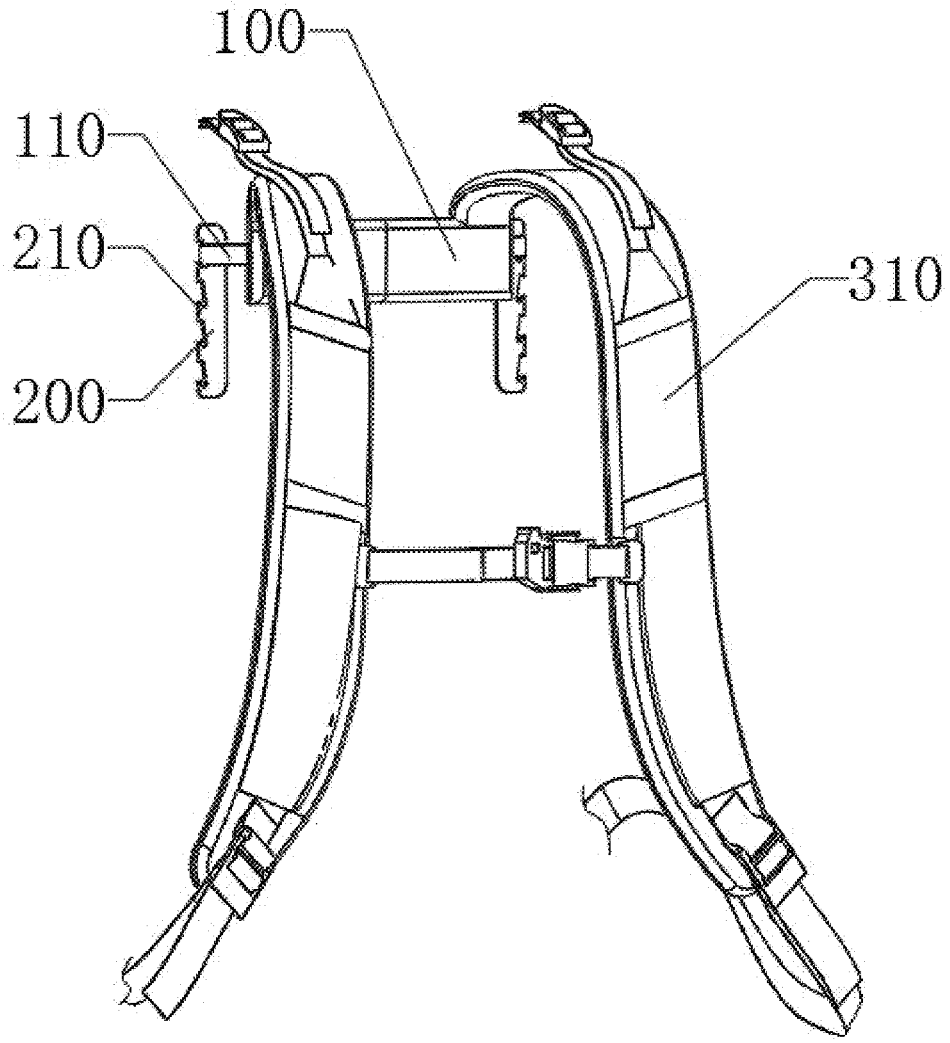
FIG. 3 is a schematic structural diagram of the adjusting device of the present disclosure.
Figure 4:
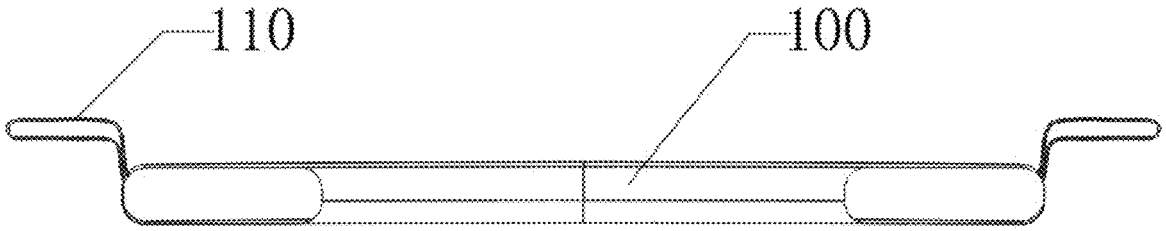
FIG. 4 is a top view of the first adjusting member of the present disclosure.

In this embodiment, as shown in FIG. 2, in order to protect the second adjusting member 200, a binding part 330 can be provided at the bag body 320 near the shoulder strap 310, and a hidden cavity can be provided at the binding part 330. The second adjusting member 200 can be partially placed in the binding part, so that the assembly part 210 is exposed. The inner side of the second adjusting member 200 is hidden, and then the assembly part 210 is exposed, which facilitates the cooperative use of the assembly member 110 and the assembly part 210 and improves the comfortability.

In this embodiment, in order to facilitate the user to use and find the assembly member 110 and the assembly part 210, the assembly part 210 on the second adjusting member 200 is arranged in a direction away from the first adjusting member 100. Generally, the assembly part 210 is easy to be found on the outside of the shoulder strap, while it is likely to be covered by the shoulder strap on the inside. Therefore, it is convenient for the user to find out the assembly part 210 in time by keeping the second adjusting member 200 away from the shoulder strap 310 with the first adjusting member 100.

In addition, the bag has two shoulder straps 310, and accordingly two second adjusting members 200 are arranged. The two second adjusting members 200 are symmetrically arranged on both sides of the first adjusting member 100, with the central axis of the first adjusting members 100 as the symmetry axis. A plurality of assembly parts 210 on the two second adjusting members 200 are symmetrically arranged, and the assembly parts 210 on the two second adjusting members 200 are arranged back to back. The assembly members 110 at both ends of the first adjusting member 100 are used in cooperation with the two symmetrical assembly parts 210, respectively, to improve the use efficiency.

The adjusting device in this embodiment is suitable for various bags, especially backpacks or shoulder bags. When the present disclosure is used in a backpack, as shown in FIG. 1, the first adjusting member 100 and the second adjusting member 200 can be fixed to the bag in various ways, such as sewing to the bag body and the shoulder strap. The left and right sides of the first adjusting member 100 are respectively provided with closed ring structures; the closed ring structure is sleeved on the second adjusting member 200. By pulling the closed ring structure to the two sides, the position of the closed ring structure can be changed between different slots of the first adjusting member 100, so that the position of the transverse structure on the bag can be adjusted. Moreover, the present disclosure is convenient to be used by the users by partially hiding the adjusting device in the bag body 320 and the shoulder strap 301.

The technical means disclosed in the scheme of the present invention are not limited to the technical means disclosed in the above embodiments, but also include the technical scheme composed of any combination of the above technical features. It should be pointed out that for those skilled in the art, several improvements and embellishments can be made without departing from the principle of the present invention, and these improvements and embellishments are also regarded as the protection scope of the present invention.

The invention has now been described in detail for the purposes of clarity and understanding. However, those skilled in the art will appreciate that certain changes and modifications may be practiced within the scope of the appended claims.

Conditional language used herein, such as, among others, "can," "could," "might," "may," "e.g.," and the like, unless specifically stated otherwise, or otherwise understood within the context as used, is generally intended to convey that certain examples include, while other examples do not include, certain features, elements, and/or steps. Thus, such conditional language is not generally intended to imply that features, elements and/or steps are in any way required for one or more examples or that one or more examples necessarily include logic for deciding, with or without author input or prompting, whether these features, elements and/or steps are included or are to be performed in any particular example.

The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Similarly, the use of "based at least in part on" is meant to be open and inclusive, in that a process, step, calculation, or other action "based at least in part on" one or more recited conditions or values may, in practice, be based on additional conditions or values beyond those recited. Headings, lists, and numbering included herein are for ease of explanation only and are not meant to be limiting.

The various features and processes described above may be used independently of one another, or may be combined in various ways. All possible combinations and sub-combinations are intended to fall within the scope of the present disclosure. In addition, certain method or process blocks may be omitted in some implementations. The methods and processes described herein are also not limited to any particular sequence, and the blocks or states relating thereto can be performed in other sequences that are appropriate. For example, described blocks or states may be performed in an order other than that specifically disclosed, or multiple blocks or states may be combined in a single block or state. The example blocks or states may be performed in serial, in parallel, or in some other manner. Blocks or states may be added to or removed from the disclosed examples. Similarly, the example systems and components described herein may be configured differently than described. For example, elements may be added to, removed from, or rearranged compared to the disclosed examples.

What is claimed is:

1. An adjusting device for a shoulder strap of a bag, comprising:

a first adjusting member arranged in a first direction, wherein two ends of the first adjusting member are each provided with a respective assembly member being an elastic closed loop fixed to the first adjusting member; and two second adjusting members arranged in a second direction along an adjusting direction of the shoulder strap on the bag;

wherein each of the respective elastic closed loops is sleeved onto a corresponding one of the two second adjusting members for moving a position of the respective elastic closed loop along the second direction while sleeved on the corresponding one of the two second adjusting members;

wherein the each of the two second adjusting members is provided with a plurality of grooves disposed along a length thereof, and each of the plurality of grooves is configured for selective engagement with the respective elastic closed loop to realize different positions of the first adjusting member on the two second adjusting members in the second direction.

2. The adjusting device for a shoulder strap of a bag according to claim 1, wherein each of the plurality of grooves is provided with an adjusting buckle for matching with one of the elastic closed loops.

3. The adjusting device for bag shoulder strap according to claim 1, wherein ends of the assembly members are fixed to the ends of the first adjusting member.

4. The adjusting device for a shoulder strap of a bag according to claim 1, wherein the bag is a backpack or a shoulder bag.

5. The adjusting device for a shoulder strap of a bag according to claim 1, wherein the bag comprises the shoulder strap and a bag body, the two second adjusting members are fixed at a side of the bag body, and the first adjusting member is connected with the shoulder strap.

6. The adjusting device for a shoulder strap of a bag according to claim 5, wherein the shoulder strap is provided with an assembly cavity along the first direction, the first adjusting member is partially hidden in the assembly cavity, and the assembly members are exposed at both ends of the assembly cavity.

7. The adjusting device for a shoulder strap of a bag according to claim 5, wherein the two second adjusting members are arranged on the bag body along a direction of the shoulder strap.

8. The adjusting device for a shoulder strap of a bag according to claim 7, wherein the plurality of grooves on the two second adjusting members are arranged in a direction away from the first adjusting member.

9. The adjusting device for a shoulder strap of a bag according to claim 8, wherein the two second adjusting members are symmetrically arranged on both sides of the first adjusting member, and the plurality of grooves on the two second adjusting members are arranged to face away from one another.

10. The adjusting device for a shoulder strap of a bag according to claim 9, wherein the two second adjusting members are arranged symmetrically with a central axis of the first adjusting member as an axis of symmetry.

11. An adjusting device for a shoulder strap of a bag, comprising:

a first adjusting member arranged in a first direction, wherein two ends of the first adjusting member are each provided with a respective assembly member being an elastic closed loop fixed to the first adjusting member wherein two ends of each of the respective assembly members are respectively fixed at a respective one of the ends of the two ends of the first adjusting member and define the elastic closed loop; and two second adjusting members arranged in a second, direction along an adjusting direction of the shoulder strap on the bag;

wherein each of the respective elastic closed loops is sleeved onto a corresponding one of the two second adjusting members for moving a position of the respective elastic closed loop along the second direction while sleeved on the corresponding one of the two second adjusting members;

wherein each of the two second adjusting members is provided with a plurality grooves equidistantly distributed along a length thereof, and each of the plurality of grooves is configured for selective engagement with the respective elastic closed loop to realize different positions of the first adjusting member on the two second adjusting members in the second direction.

12. An adjusting device for a shoulder strap of a bag, comprising:

a first adjusting member arranged in a first direction and two second adjusting members arranged in a second direction;

wherein the first adjusting member and the two second adjusting members are engaged and connected in the second direction;

wherein two ends of the first adjusting member are each provided with a respective assembly member being an elastic rope fixed to the first adjusting member;

wherein ends of the respective elastic rope are each fixed at a corresponding end of the ends of the first adjusting member to define a closed loop;

wherein each of the respective closed loops is sleeved onto a corresponding one of the two second adjusting members for moving a position of the respective elastic rope along the second direction while sleeved on the corresponding one of the two second adjusting members;

wherein the each of the two second adjusting members is provided with a plurality of grooves equidistantly distributed along a length thereof, and each of the plurality of grooves is configured for selective engagement with the respective elastic rope to realize different positions of the first adjusting member on the two second adjusting members in the second direction.

13. The adjusting device for a shoulder strap of a bag according to claim 12, wherein an adjusting buckle is arranged in each of the plurality of grooves, and configured to be hooked and connected with one of the elastic ropes.

* * * * *